US005721559A

United States Patent [19]

Nagakubo

[11] Patent Number: 5,721,559

[45] Date of Patent: Feb. 24, 1998

[54] PLASMA DISPLAY APPARATUS

[75] Inventor: Tetsuroh Nagakubo, Koufu, Japan

[73] Assignee: Pioneer Electronic Corporation, Tokyo, Japan

[21] Appl. No.: 500,418

[22] Filed: Jul. 10, 1995

[30] Foreign Application Priority Data

Jul. 18, 1994 [JP] Japan ..... 6-165140

[51] Int. Cl.[6] ..... G09G 3/28

[52] U.S. Cl. ..... 345/63; 345/78

[58] Field of Search ..... 345/63, 77, 78, 345/94, 95

[56] References Cited

U.S. PATENT DOCUMENTS 4,443,741 4/1984 Tanaka et al. ..... 345/78
4,983,885 1/1991 Fujioka et al. ..... 345/78
5,301,047 4/1994 Hoshino et al. ..... 345/95
5,329,288 7/1994 Kim ..... 345/63
5,343,215 8/1994 Tanaka ..... 345/63

*Primary Examiner*—Richard Hjerpe
*Assistant Examiner*—Xu-Ming Wu
*Attorney, Agent, or Firm*—Perman & Green, LLP

[57] ABSTRACT

A plasma display apparatus designed to prevent the luminance level from dropping, thus ensuring excellent emission-oriented display. The quantity of high-luminance pixel data whose luminance levels become equal to or higher than a predetermined level is detected. When the detected pixel data quantity is greater than a predetermined number, the luminance level of the plasma display panel is increased by a predetermined level in effecting a discharge-oriented light emission display.

4 Claims, 9 Drawing Sheets

UPPER THREE BITS

| BIT 7 | BIT 6 | BIT 5 | BIT 4 | BIT 3 | BIT 2 | BIT 1 | BIT 0 | |
|---|---|---|---|---|---|---|---|---|
| 1 | 0 | 0 | 1 | 0 | 1 | 0 | 1 | PIXEL 1 |
| 1 | 0 | 1 | 0 | 0 | 0 | 0 | 1 | PIXEL 2 |
| 1 | 1 | 0 | 0 | 1 | 0 | 1 | 0 | PIXEL 3 |
| | | | | | | | | FOR ONE ROW |
| 1 | 1 | 1 | 0 | 0 | 0 | 0 | 0 | PIXEL N-1 |
| 0 | 0 | 1 | 0 | 1 | 0 | 1 | 0 | PIXEL N |

FIG.9

| ADDRESS X | DATA |
|---|---|
| 0 | COMPENSATION DATA 1 |
| 100 | COMPENSATION DATA 2 |
| 200 | COMPENSATION DATA 3 |
| 300 | COMPENSATION DATA 4 |
| ⋮ | ⋮ |

PLASMA DISPLAY APPARATUS

BACKGROUND OF THE INVENTION

1. Field of the Invention

The present invention relates to an AC discharge matrix type plasma display apparatus.

2. Description of Background Information

Various kinds of plasma display panels as one type of two-dimensional flat screen display have been studied recently. One known plasma display panel is an AC discharge matrix type plasma display apparatus having a memory function.

This AC discharge matrix type plasma display apparatus sequentially discharges to emit light row by row in accordance with pixel data to display one field of images.

Row electrodes are transparent electrodes made of indium oxide or the like and have a surface resistance of several scores to several hundred ohms. When the number of light-emitting pixels is increased to thereby increase the amount of current flowing to the row electrodes, the voltage drop caused by the surface resistance increases, too. This undesirably reduces the amount of light emission caused by the discharge.

SUMMARY OF THE INVENTION

With a view to solving the above-mentioned problem, the present invention has been accomplished, and it is an objective of the invention to provide a plasma display apparatus which is designed to prevent the luminance level from dropping, thus ensuring excellent emission-oriented display.

To achieve this object, according to the present invention, there is provided a plasma display apparatus including a plasma display panel for performing a discharge-oriented emission display in accordance with pixel data pulses corresponding to plural pieces of pixel data each associated with one pixel, which apparatus comprises:

high-luminance pixel data quantity detecting means for detecting a quantity of high-luminance pixel data from the plural pieces of pixel data whose luminance levels become equal to or higher than a predetermined level, as a detected pixel data quantity; and luminance level adjusting means for performing a luminance control in such a way as to increase a luminance level of the plasma display panel by a predetermined level, when the detected pixel data quantity is greater than a predetermined number.

According to the plasma display apparatus embodying this invention, the quantity of high-luminance pixel data whose luminance levels become equal to or higher than a predetermined level is detected. When the detected pixel data quantity is greater than a predetermined number, the luminance level of the plasma display panel is increased by a predetermined level in effecting a discharge-oriented light emission.

BRIEF DESCRIPTION OF THE DRAWINGS

FIG. 9 is a diagram showing one example of a memory map in a compensation data memory 44.

DETAILED DESCRIPTION OF PREFERRED EMBODIMENTS

Before entering into the description of an embodiment of the present invention, a conventional plasma display apparatus will now be described referring to the accompanying drawings.

Figure 1:
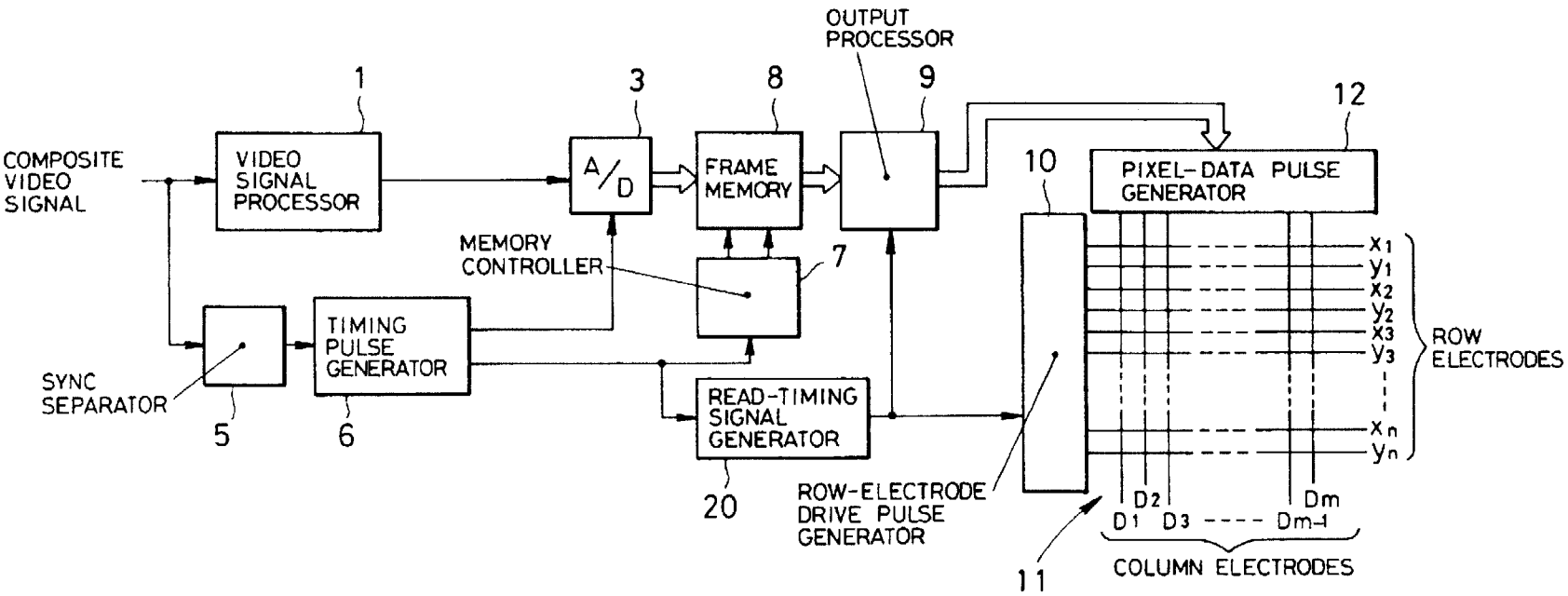
FIG. 1 is a diagram showing the constitution of a conventional plasma display apparatus.

FIG. 1 shows the constitution of a plasma display apparatus equipped with an AC discharge matrix type plasma display panel having a memory function.

Referring to FIG. 1, a video signal processor 1 separates an R video signal corresponding to a red video component, a G video signal corresponding to a green video component and a B video signal corresponding to a blue video component from a supplied composite video signal, and supplies those separated video signals to an A/D converter 3. A sync separator 5 obtains horizontal and vertical sync signals from the composite video signal and supplies them to a timing pulse generator 6. The timing pulse generator 6 generates various kinds of timing pulses based on the horizontal and vertical sync signals. In synchronism with the timing pulses from the timing pulse generator 6, the A/D converter 3 converts each of the R video signal, G video signal and B video signal to digital pixel data pixel by pixel and supplies the digital pixel data to a frame memory 8. A memory controller 7 supplies a write signal or a read signal, synchronous with the timing pulse supplied from the timing pulse generator 6, to the frame memory 8. The frame memory 8 sequentially holds individual pixel data supplied from the A/D converter 3 in accordance with the write signal. In accordance with the read signal, pixel data stored in the frame memory 8 is read out and is supplied to an output processor 9 located at the succeeding stage.

The read-timing signal generator 20 generates timing signals associated with the supply timings for a scan pulse for starting discharge-oriented light emission, a sustain pulse for keeping the discharge state and an erase pulse for stopping the light emission, and supplies those timing signals to a row-electrode drive pulse generator 10. The read-timing signal generator 20 also generates a timing signal associated with the supply timing for a pixel data pulse and supplies it to the output processor 9. The output processor 9 produces first to eighth mode pixel data corresponding to the luminance gradation for one field of pixel data supplied from the frame memory 8, and supplies those pixel data to a pixel-data pulse generator 12 in synchronism with the timing signal from the read-timing signal generator 20. In response to the individual timing signals supplied from the read-timing signal generator 20, the row-electrode drive pulse generator 10 generates the scan pulse for starting discharge-oriented light emission and the sustain pulse for keeping the discharge state, and supplies those pulses to row electrodes $Y_1, Y_2, Y_3, \ldots, Y_{n-1}$ and $Y_n$ and $X_1, X_2, X_3, \ldots, X_{n-1}$ and $X_n$ of a PDP (Plasma Display Panel) 11.

The pixel-data pulse generator 12 generates pixel data pulses having voltage values corresponding to a logic "1" or "0" of one field of pixel data supplied from the output processor 9, and divides those pulses row by row. The pixel-data pulse generator 12 applies the divided row-by-row pixel data pulses to column electrodes $D_1, D_2, D_3, \ldots, D_{m-1}$ and $D_m$ in a time divisional fashion. One pixel is formed by the intersection between each column electrode and each row electrode.

Figure 2:
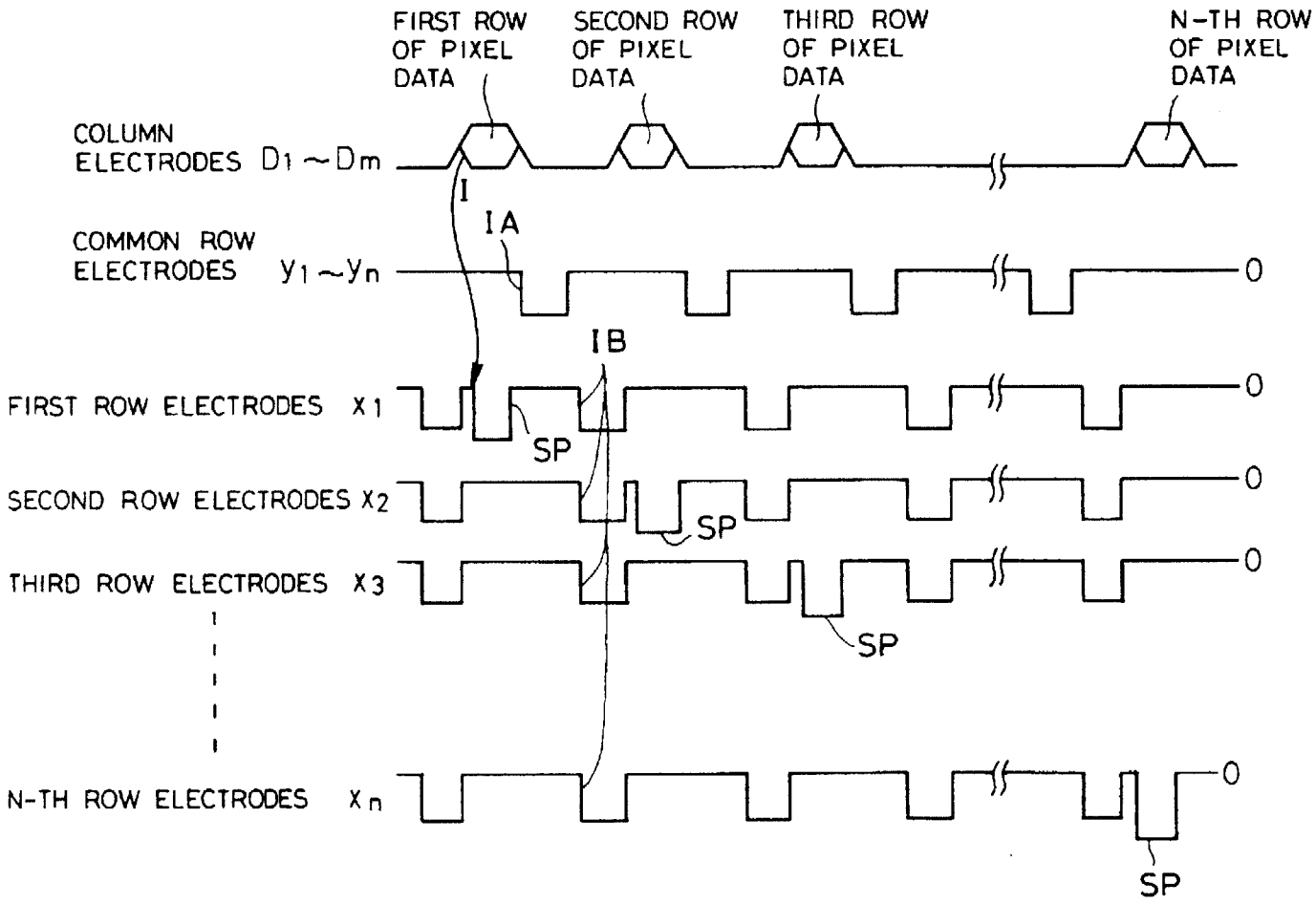
FIG. 2 is a diagram exemplifying the operation of the plasma display apparatus.

FIG. 2 exemplifies the operation timing of the above plasma display apparatus.

First, the pixel-data pulse generator 12 applies a positive pixel data pulse to the column electrodes $D_1$ to $D_m$ based on pixel data corresponding to the first row of pixels. For example, no pixel data pulse is applied to the column electrodes when the pixel data has a logic "0", and the positive pixel data pulse is applied to the column electrodes only when the pixel data has a logic "1". At the same time as the application of the pixel data pulse, the row-electrode drive pulse generator 10 applies a negative scan pulse SP to first row electrodes $x_1$. In the first row, discharge-oriented light emission occurs between the first row electrodes $x_1$ and those column electrodes to which the positive pixel data pulse has been applied. Then, the pixel-data pulse generator 12 applies the positive pixel data pulse to the column electrodes $D_1$ to $D_m$ based on pixel data corresponding to the second row of pixels. At the same time as the application of the pixel data pulse, the row-electrode drive pulse generator 10 applies the negative scan pulse SP to second row electrodes $x_2$. In the second row, discharge-oriented light emission occurs between the second row electrodes $x_2$ and those column electrodes to which the positive pixel data pulse has been applied. At this time, the row-electrode drive pulse generator 10 applies negative sustain pulses IA and IB to the row electrodes $y_1$ to $y_n$ and row electrodes $x_1$ to $x_n$ in a period during which the scan pulse SP is not applied. The above operation is repeated up to the n-th row electrodes $x_n$ to accomplish emission display for one field of images.

This AC discharge matrix type plasma display apparatus sequentially executes discharge-oriented light emission row by row in accordance with pixel data to display one field of images in the above-described manner.

As mentioned earlier, however, the row electrodes $y_1$ to $Y_n$ and $x_1$ to $x_n$ are transparent electrodes made of indium oxide or the like and have a surface resistance of several scores to several hundred ohms. When the number of light-emitting pixels is increased to thereby increase the amount of current flowing to the row electrodes, therefore, the voltage drop caused by the surface resistance also increases. This undesirably reduces the amount of light emission caused by the discharge.

Figure 3:
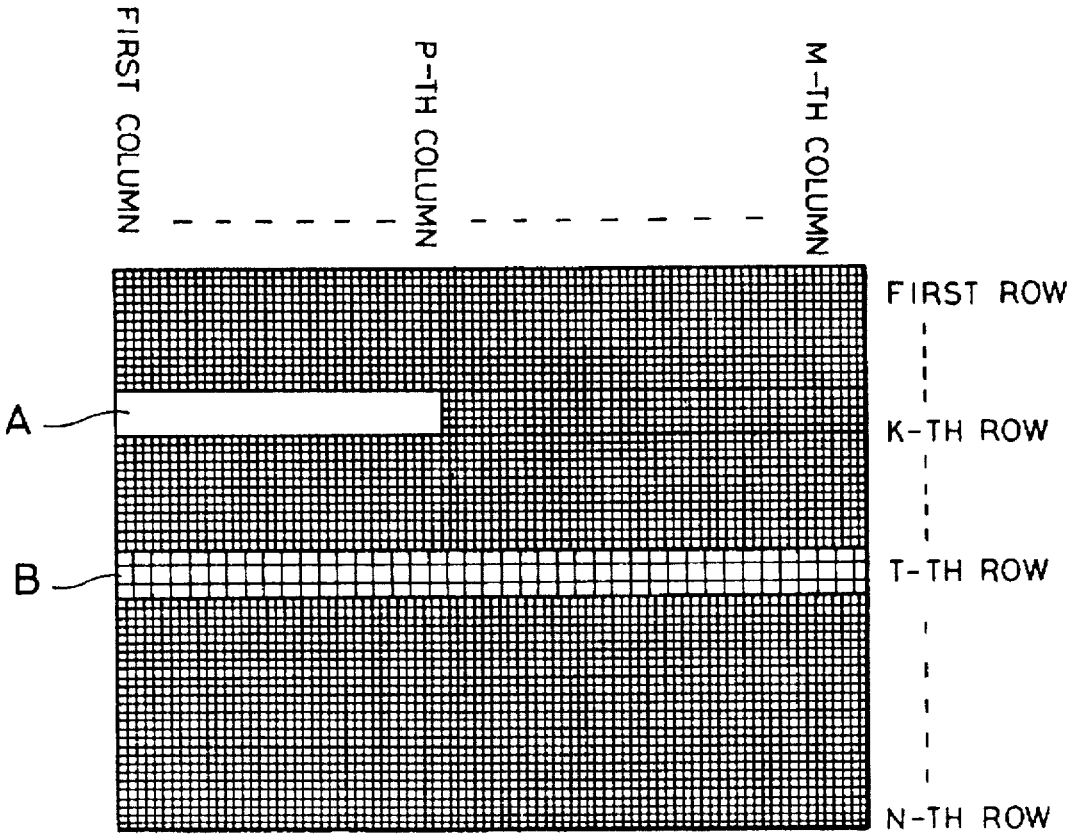
FIG. 3 is a diagram showing an example of the display of a plasma display panel 11.

As shown in FIG. 3, for example, a white peak display part B of the PDP 11 where the first column to the m-th column in the t-th row are all displayed with the white peak has a lower luminance than a white peak display part A where the first column to the p-th column in the k-th row are all displayed with the white peak.

One embodiment of this invention will now be described in detail.

Figure 4:
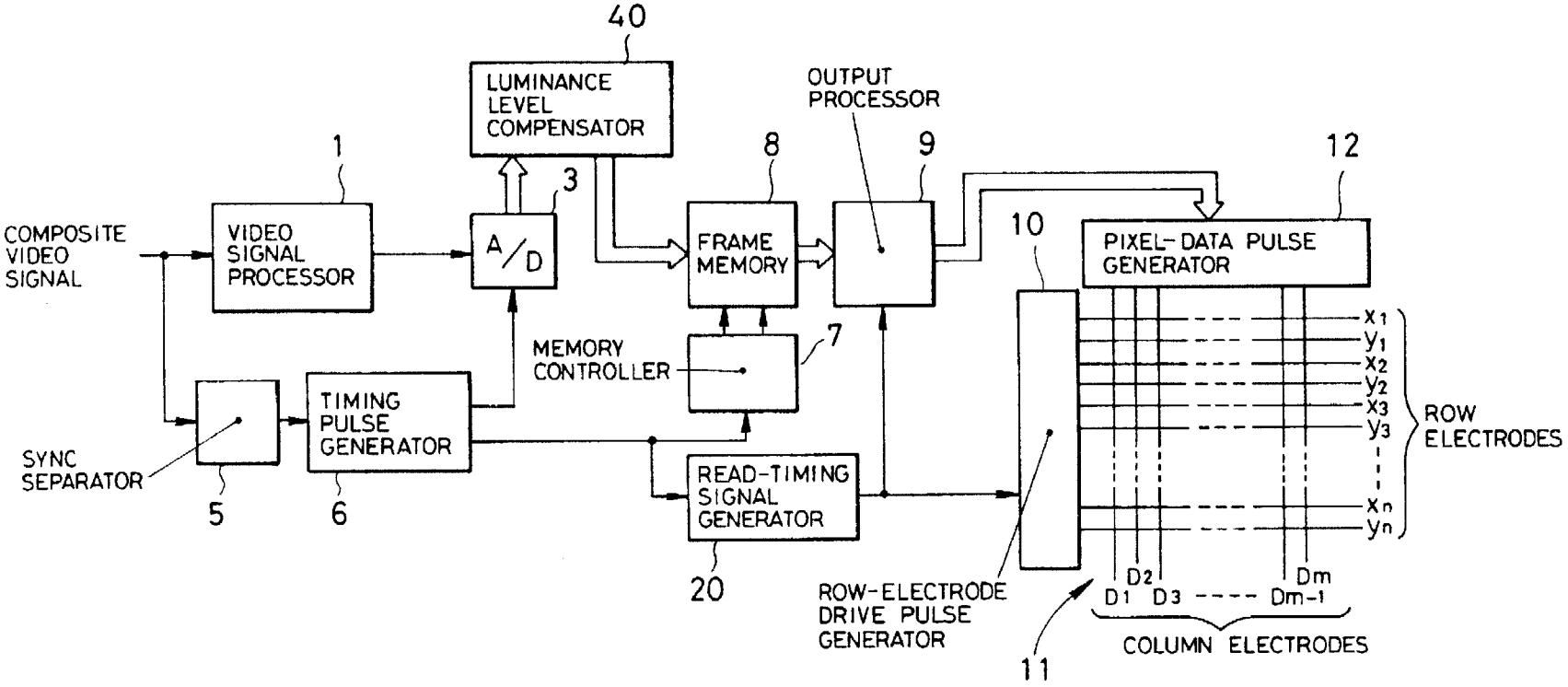
FIG. 4 is a diagram showing the constitution of a plasma display apparatus according to this invention.

FIG. 4 illustrates the constitution of a plasma display apparatus according to this invention.

In FIG. 4, a video signal processor 1 separates an R video signal corresponding to a red video component, a G video signal corresponding to a green video component and a B video signal corresponding to a blue video component from a supplied composite video signal, and supplies those separated video signals to an A/D converter 3. A sync separator 5 obtains horizontal and vertical sync signals from the composite video signal and supplies them to a timing pulse generator 6. The timing pulse generator 6 generates various kinds of timing pulses based on the horizontal and vertical sync signals. A memory controller 7 supplies a write signal or a read signal synchronous with the timing pulse from the timing pulse generator 6.

In synchronism with the timing pulses from the timing pulse generator 6, the A/D converter 3 converts each of the R video signal, G video signal and B video signal to digital pixel data pixel by pixel and supplies the digital pixel data to a luminance level compensator 40.

Figure 5:
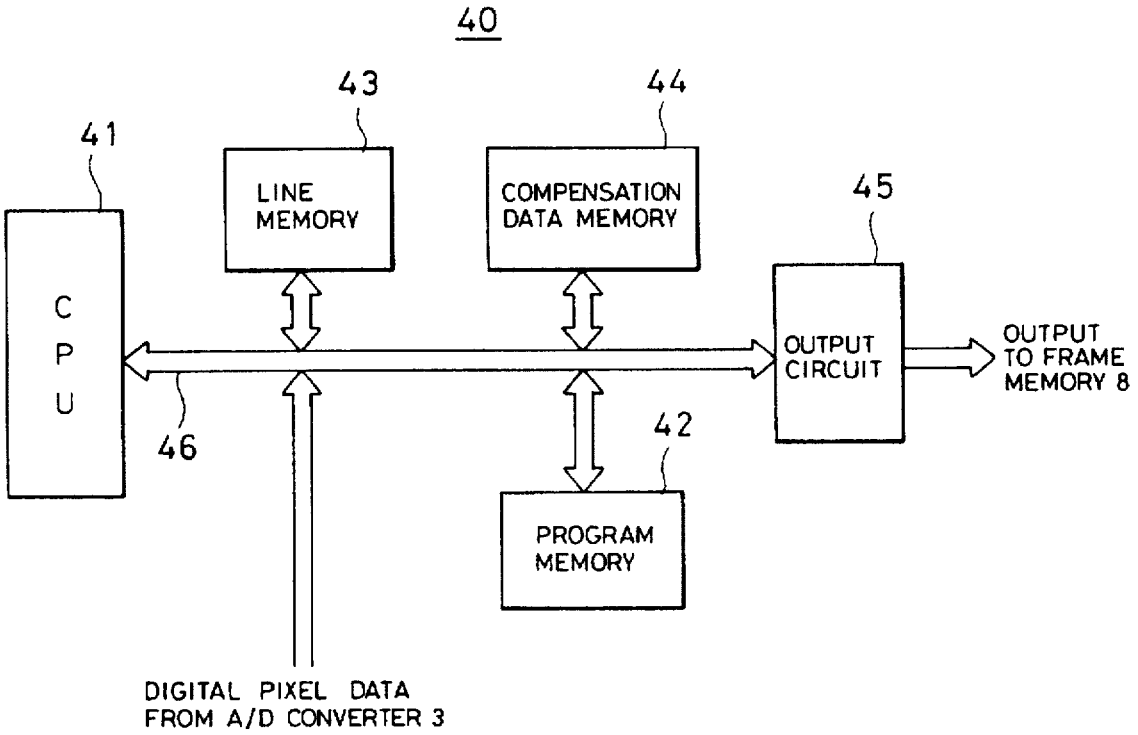
FIG. 5 is a diagram exemplifying the constitution of a luminance level compensator 40.

FIG. 5 shows the constitution of the luminance level compensator 40.

In FIG. 5, a CPU (Central Processing Unit) 41 controls the operations of a line memory 43, a compensation data memory 44 and an output circuit 45 in accordance with a sequence of commands stored in a program memory 42. At this time, the CPU 41 supplies various command signals via a CPU bus 46 to the line memory 43, compensation data memory 44 and output circuit 45 to perform the mentioned operational control. The CPU 41 receives digital pixel data supplied from the A/D converter 3 via the CPU bus 46.

Figure 6:
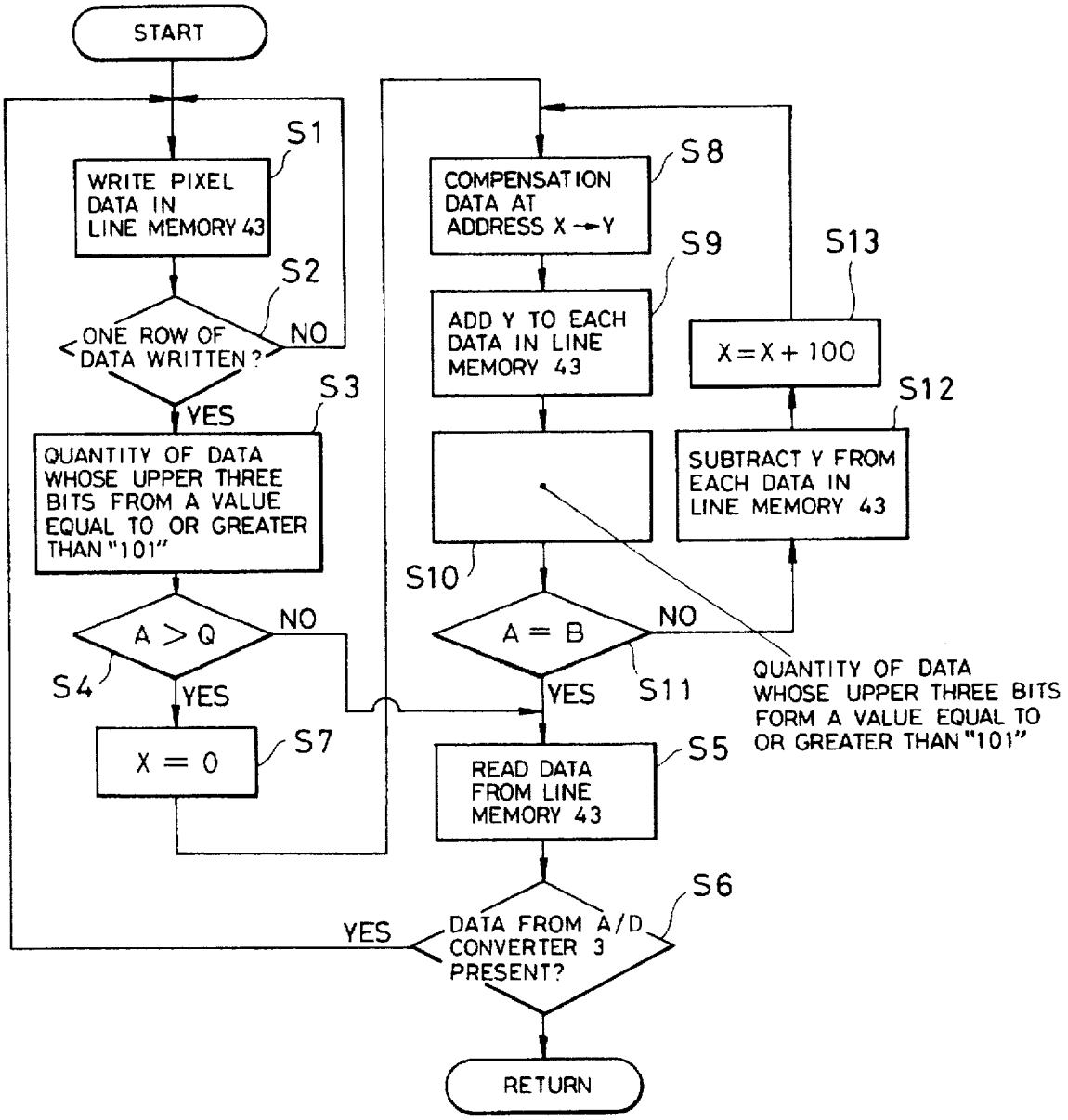
FIG. 6 is a diagram illustrating a control flow executed by a CPU 41.

FIG. 6 illustrates the flow of a subroutine of the control operation executed by the CPU 41 in accordance with the mentioned command sequence.

Figures 7, 8:
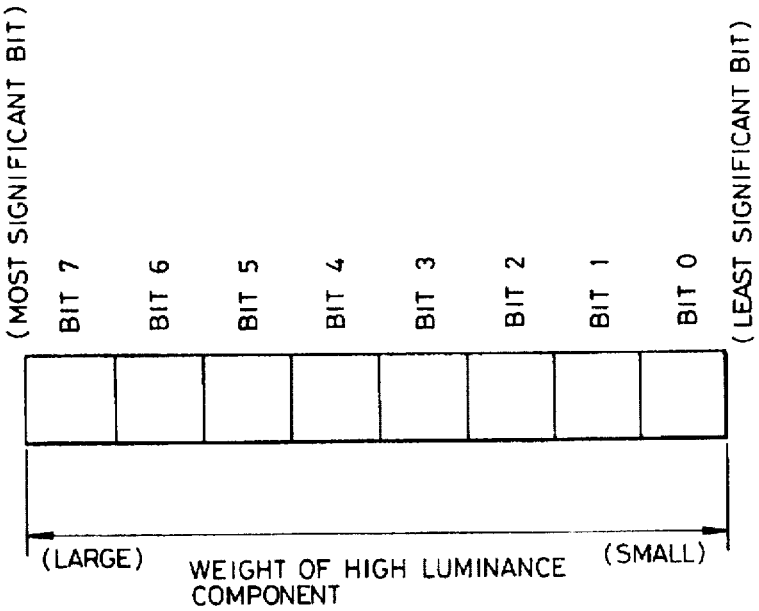
FIG. 7 is a diagram exemplifying the data format of digital pixel data.
FIG. 8 is a diagram exemplifying the storage state of a line memory 43.

In FIG. 6, when acknowledging the supply of digital pixel data from the A/D converter 3, the CPU 41 supplies a write command signal to the line memory 43 (step S1). As step S1 is performed, digital pixel data for the individual pixels supplied from the A/D converter 3 is sequentially written in the line memory 43. FIG. 7 shows one example of the data format of such digital pixel data. As shown in FIG. 7, digital pixel data corresponding to one pixel consists of eight bits, bit 0 (least significant bit) to bit 7 (most significant bit). The higher the bits are, the greater the weights of the high luminance component becomes. The line memory 43 sequentially writes the digital pixel data in the units of eight bits corresponding to one pixel as shown in FIG. 8. Next, the CPU 41 determines if one row of digital pixel data has been written in the line memory 43 (step S2). When it is determined in step S2 that one row of digital pixel data has not been written yet, the CPU 41 returns to the step S1 and repeats the above-described operation until one row of digital pixel data is written in the line memory 43. When it is determined in step S2 that one row of digital pixel data has been written in the line memory 43, the CPU 41 reads the upper three bits of each 8-bit data (i.e., bits 7, 6 and 5) as shown in FIG. 8, and stores the number of 8-bit data whose upper three bits take a value equal to or greater than "101" into an internal register A (not shown) (step S3). In the example shown in FIG. 8, for example, the upper three bits of each of three 8-bit data corresponding to pixels 2, 3 and n−1 take a value equal to or greater than "101". In this case, therefore, "3" is stored in the internal register A.

Next, the CPU 41 determines if the number stored in the internal register A is larger than a predetermined value Q (step S4). When it is not determined in step S4 that the number stored in the internal register A is larger than the predetermined value Q, the CPU 41 supplies a read command signal to the line memory 43 and an output command signal to the output circuit 45 (step S5). Through the execution of this step S5, the digital pixel data shown in FIG. 8 is read from the line memory 43 onto the CPU bus 46 for every eight bits. At this time, the output circuit 45 supplies the digital pixel data, read onto the CPU bus 46, to the frame memory 8. When one row of digital pixel data written in the line memory 43 is all read onto the CPU bus 46, the CPU 41 determines if there is any further digital pixel data to be supplied from the A/D converter 3 (step S6). When it is determined in step S6 that there is the supply of further digital pixel data from the A/D converter 3, the CPU 41 returns to the step S1 and repeats the above-described operation.

When it is determined in step S4 that the number stored in the internal register A is larger than the predetermined value Q, the CPU 41 stores an address 0 in an address register X (not shown) for compensation data reading address (step S7). Then, the CPU 41 reads compensation data, from the compensation data memory 44, stored at the address indicated by the data stored in the register X, and stores the compensation data into an internal register Y (not shown) (step S8). FIG. 9 shows one example of the memory map of the compensation data memory 44. In FIG. 9, the smaller the code affixed to the compensation data becomes, the greater the value of that compensation data becomes.

The CPU 41 then adds the compensation data stored in the internal register Y to every 8-bit data for one pixel stored in the line memory 43 (step S9). Next, the CPU 41 reads the upper three bits (i.e., bits 7, 6 and 5) of each 8-bit data in the line memory 43 undergone the addition, and stores the value of 8-bit data whose upper three bits form a value equal to or greater than "101" into an internal register B (not shown) (step S10). The CPU 41 then determines if the value stored in the internal register A matches with the value stored in the internal register B (step S11). When it is determined in step S11 that the value stored in the internal register A matches with the value stored in the internal register B, the CPU 41 executes the aforementioned step S5. As a result, digital pixel data to which the compensation data has been added is read from the line memory 43 to be supplied to the frame memory 8.

When it is not determined in step S11 that the value stored in the internal register A matches with the value stored in the internal register B, the CPU 41 subtracts the compensation data, stored in the internal register Y, from each 8-bit data for one pixel stored in the line memory 43 (step S12). Then, the CPU 41 adds "100" to the stored content of the address register X for compensation data reading address (step S13). After the execution of the step S13, the CPU 41 proceeds again to step S8 to repeat the above-described operation. When it is determined in the step S6 that no further digital pixel data will be supplied from the A/D converter 3, the CPU 41 leaves the above-described subroutine flow and terminates the luminance level compensating operation.

In this subroutine flow, first, the quantity of pixel data which are expected to have high luminances whose levels are equal to or greater than a predetermined level (pixel data whose upper three bits form a value equal to or greater than "101") is obtained from one row of digital pixel data supplied from the A/D converter 3 (steps S1 through S3). That is, the quantity of high-luminance pixel data is detected in the sequence of steps S1–S3. Next, it is determined if the obtained quantity of pixel data exceeds a predetermined number (Q) (step S4). When the quantity does not exceed the predetermined number (Q), one row of digital pixel data supplied form the A/D converter 3 is supplied directly to the frame memory 8 (step S5). When the quantity exceeds the predetermined number (Q), on the other hand, predetermined compensation data is added to each pieces of such one row of digital pixel data (step S9) and the resultant pixel data is supplied to the frame memory 8 (step S5). When the value of the upper three bits of each 8-bit pixel data after the addition of the compensation data becomes different from the value before the addition, the compensation data is subtracted from each compensation-data added 8-bit pixel data to restore the 8-bit pixel data (step S12), and then compensation data which has a smaller value than the previous compensation data is added to the resultant 8-bit pixel data (steps S13, S8 and S9). The above operation (steps S8–S13) is executed until the value of the upper three bits of each 8-bit pixel data becomes equal to the value before the addition. In other words, pixel data is compensated to have high luminance to such a level that the value of the upper three bits of each 8-bit pixel data becomes equal to the value before the addition.

Through the above-described operation, the luminance level compensator 40 obtains the total quantity of high-luminance pixel data which are expected to have luminance levels that are equal to or greater than the predetermined level for each row, and when the total quantity exceeds the predetermined number, compensation data is added to pixel data associated with that row to increase the luminance level and the resultant pixel data is supplied to the frame memory 8.

The frame memory 8 sequentially stores pixel data supplied from the luminance level compensator 40 in accordance with the write signal supplied from the memory controller 7. In accordance with the read signal from the memory controller 7, pixel data stored in the frame memory 8 is sequentially read out and supplied to the output processor 9 located at the succeeding stage. The read-timing signal generator 20 generates timing signals associated with the supply timings for the scan pulse for starting discharge-oriented light emission, the sustain pulse for keeping the discharge state and the erase pulse for stopping the light emission, and supplies those timing signals to the row-electrode drive pulse generator 10. The read-timing signal generator 20 also generates the timing signal associated with the supply timing for a pixel data pulse and supplies it to the output processor 9. The output processor 9 produces first to eighth mode pixel data corresponding to the luminance gradation for one field of pixel data supplied from the frame memory 8, and supplies those pixel data to the pixel-data pulse generator 12 in synchronism with the timing signal from the read-timing signal generator 20. In response to the individual timing signals supplied from the read-timing signal generator 20, the row-electrode drive pulse generator 10 generates the scan pulse for starting discharge-oriented light emission and the sustain pulse for keeping the discharge state and supplies those pulses to row electrodes $Y_1, \ldots, Y_n$ and $X_1, \ldots, X_n$ of the PDP 11. The pixel-data pulse generator 12 generates pixel data pulses having voltage values corresponding to a logic "1" or "0" of one field of pixel data supplied from the output processor 9, and divides those pulses row by row. The pixel-data pulse generator 12 applies the divided row-by-row pixel data pulses to the column electrodes $D_1$ to $D_m$ in a time divisional fashion.

According to the plasma display apparatus of this embodiment, as described above, the total quantity of high-luminance pixel data whose luminance levels become equal to or higher than a predetermined level is obtained row by row, and for the row for which the total quantity becomes larger than a predetermined number, compensation data is added to each pixel data associated with that row to increase the luminance level for the row, yielding compensated pixel data. Based on the compensated pixel data, discharge-oriented emission display is accomplished.

According to this invention, for the row whose white peak display pixels are expected to become greater in number to reduce the luminance at the time the discharge-oriented emission is effected, compensation data is added to the pixel data associated with that row to compensate for the reduction in luminance in the stage of pixel data.

While compensation data is added to every pixel data in this embodiment, it is preferable that this compensation data has such a weight that the luminance near the center of the screen is higher than the luminances at the edge of the screen.

Although the reduction in luminance is compensated at the pixel data stage by adding compensation data to pixel data in the above-described embodiment, the number of light emissions (per unit time) caused by the sustained discharge may be adjusted instead of altering pixel data.

Figure 10:
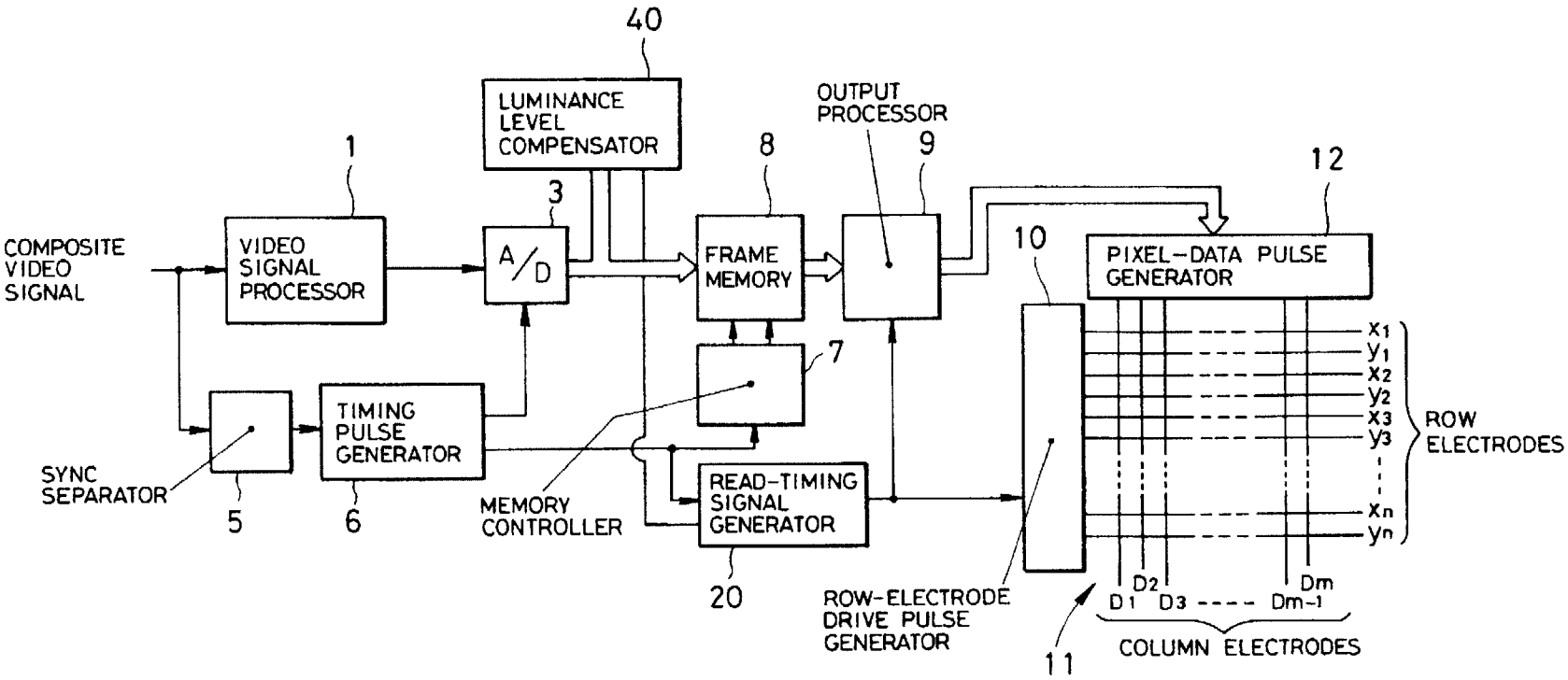
FIG. 10 is a diagram showing the structure of a plasma display apparatus according to another embodiment of this invention.

FIG. 10 shows the structure of a plasma display apparatus according to another embodiment of the present invention which accomplishes this operation.

In FIG. 10, same reference numerals as used in FIG. 4 are given to functional blocks corresponding or identical to those shown in FIG. 4.

In FIG. 10, in synchronism with the timing pulse supplied from the timing pulse generator 6, the A/D converter 3 converts a video signal supplied from the video signal processor 1 to digital pixel data which is in turn supplied to the luminance level compensator 40 and frame memory 8. The total quantity of pixels which are expected to have luminance levels that become equal to or greater than a predetermined level is obtained based on one row of pixel data supplied from the A/D converter 3. For the row for which the total quantity becomes larger than a predetermined number, an instruction signal to increase the number of applications per unit time of the sustain pulse to be applied to this row is supplied to the read-timing signal generator 20. At this time, the read-timing signal generator 20 adjusts the number of generations per unit time of the timing signal associated with the supply timing for the sustain pulse in accordance with the instruction signal.

According to this embodiment, the total quantity of pixel data whose luminance levels become equal to or higher than a predetermined level is obtained row by row, and for the row for which the total quantity becomes larger than a predetermined number, the number of applications per unit time of the sustain pulse is increased. That is, the reduction in luminance is compensated to provide high-luminance pixel data by increasing the frequency of the sustain pulse.

According to the plasma display apparatus of this invention, as described above, the number of pixel data whose luminance levels become equal to or greater than a predetermined level is detected, and when this number becomes larger than a predetermined number, the luminance level of the plasma display panel is forcibly increased by a predetermined level.

According to this invention, even when there are many pixels to accomplish the white peak display, it is possible to provide an excellent discharge-oriented emission display of the plasma display panel without reducing the luminance level.

What is claimed is:

1. A plasma display apparatus including a plasma display panel for performing a discharge-oriented emission display in accordance with first pixel data pulses consisting of multiple bits of pixel data associated with each pixel of a scan row, said apparatus comprising:

means to detect bits of the first pixel data, compare said bits of the first pixel data to a predetermined level of high-luminance, and select said bits of the first pixel data which are equal to or greater than said predetermined level of high-luminance;

means to count the number of said selected bits of the first pixel data in the scan row and store said number;

means to compare said stored number to a predetermined value indicative of the luminance of the scan row;

means to store predetermined compensation data designed to increase the luminance of said bits of the first pixel data;

luminance level adjusting means to add the compensation data to each bit of the first pixel data in the scan row when said stored number is larger than said predetermined value to generate second pixel data pulses which include said compensation data; and means to detect bits of second pixel data, compare said bits of second pixel data to the predetermined level of high-luminance, and select said bits of second pixel data which are equal to or greater than said predetermined level of high-luminance;

means to count the number of said selected bits of second pixel data in the scan row and store said number;

means to compare said stored number for the first pixel data with said stored number for the second pixel data; and means to generate pixel data pulses which are based on said second pixel data when said stored number for the second data is equal to said stored number for the first data.

2. A plasma display apparatus including a plasma display panel for performing a discharge-oriented emission display in accordance with first pixel data pulses corresponding to plural bits of pixel data associated with each pixel of a scan row, as described in claim 1 wherein said means to store predetermined compensation data is designed to include multiple levels of compensation and further wherein the luminance level adjusting means adds a different level of compensation data to each bit of first pixel data when said stored number for the second data is not equal to said stored number for the first data.

3. In a plasma display apparatus including a plasma display panel for performing a discharge-oriented emission display in accordance with first pixel data pulses consisting of multiple bits of pixel data associated with each pixel of a scan row, a method of compensating for a decline in luminance comprising the steps of:

detecting bits of the first pixel data, comparing said bits of first pixel data to a predetermined level of high-luminance, and selecting said bits of first pixel data which are equal to or greater than said predetermined level of high-luminance;

counting the number of said selected bits of first pixel data in the scan row and storing said number;

comparing said stored number to a predetermined value indicative of the luminance of the scan row;

storing predetermined compensation data designed to increase the luminance of said bits of the first pixel data;

adding the compensation data to each bit of the first pixel data in the scan row when said stored number is larger than said predetermined value and generating second pixel data pulses including said compensation data; and detecting bits of second pixel data, comparing said bits of second pixel data to the predetermined level of high-luminance, and selecting said bits of second pixel data which are equal to or greater than said predetermined level of high-luminance;

counting the number of said selected bits of second pixel data in the second scan row and storing said number;

comparing said stored number for the first pixel data with said stored number for the second pixel data; and generating pixel data pulses which are based on said second pixel data when said stored number for the second data is equal to said stored number for the original data.

4. In a plasma display apparatus including a plasma display panel for performing a discharge-oriented emission display in accordance with first pixel data pulses corresponding to plural bits of pixel data associated with each pixel of a scan row, as described in claim 3, wherein the step of storing predetermined compensation data includes multiple levels of compensation and further wherein the step of adding compensation data includes adding a different level of compensation data to each bit of pixel data when said stored number for the second data is not equal to said stored number for the first data.

* * * * *